United States Patent [19]

Murphy

[11] 3,931,894

[45] Jan. 13, 1976

[54] DISPLAY PANEL AND ASSEMBLY

[76] Inventor: Thomas V. Murphy, P.O. Box 156, Oradell, N.J. 07649

[22] Filed: Jan. 16, 1974

[21] Appl. No.: 433,743

[52] U.S. Cl. ..... 211/177; 211/163

[51] Int. Cl.[2] ..... A47F 5/02

[58] Field of Search ..... 248/DIG. 3; 211/177, 163, 211/169, 183; 16/DIG. 13, 171; 312/107, 108, 262, 263, 257 A; 220/4 F, 60; 160/135, 235, 229

[56] References Cited

UNITED STATES PATENTS

| | | | |
|---|---|---|---|
| 1,393,050 | 10/1921 | Talley et al. | 312/135 |
| 2,239,562 | 4/1941 | Kennedy | 160/229 R |
| 2,732,581 | 1/1956 | Heck | 16/171 X |
| 2,797,840 | 7/1957 | Gibbs | 16/171 X |
| 3,452,959 | 7/1969 | Ishikawa | 248/488 |
| 3,581,906 | 6/1971 | Joyce | 211/126 |
| 3,672,530 | 6/1972 | Bridenstine et al. | 220/4 A |
| 3,739,919 | 6/1973 | Hochman | 211/57 |
| 3,756,421 | 9/1973 | Wilkins | 211/177 X |
| 3,756,422 | 9/1973 | Ostring et al. | 211/177 X |

FOREIGN PATENTS OR APPLICATIONS

| | | | |
|---|---|---|---|
| 951,991 | 3/1964 | United Kingdom | 220/4 F |

*Primary Examiner*—Roy D. Frazier
*Assistant Examiner*—Robert W. Gibson, Jr.
*Attorney, Agent, or Firm*—Mandeville and Schweitzer

[57] ABSTRACT

The disclosure relates to a novel display panel, and to assembled display structures incorporating the new panel. More particularly, the disclosure relates to perforated display panels, and to display assemblies constructed therewith. Commonly, perforated board panels are formed of compressed, fibrous material. To a somewhat lesser degree, perforated panel boards are available commercially, formed of sheet metal and of molded plastic material. The present invention provides a novel and highly advantageous form of molded plastic perforated panel structure which, because of novel and advantageous features of construction, has extensive utility in the merchandise display field, as well as in the other fields of use.

The perforated display panel of the invention desirably is of rectangular configuration and incorporates along its side and end edges, unique snap-together hinge elements, enabling the panels to be connected easily and quickly to similar, adjacent panels. The structure of the invention, while being capable of mass production at reasonable cost by injection molding techniques, provides an extremely versatile, universal form of structural element, which can be combined in various ways, and easily set up or taken down for display purposes.

The invention is also directed to the provision of novel display assemblies, utilizing the new panels in conjunction with specially designed and constructed end caps. The end caps are provided in various geometric configurations and are applied to the ends of an assembled series of display panels to form a rigid structure.

7 Claims, 16 Drawing Figures

FIG. 4
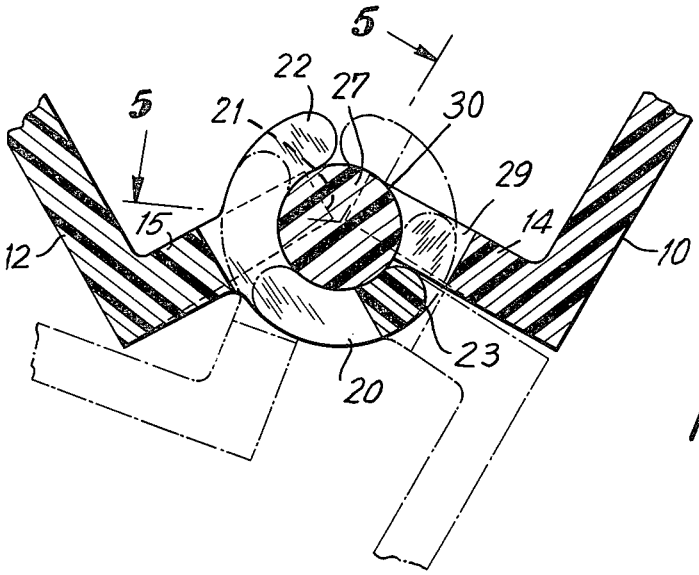
FIG. 5
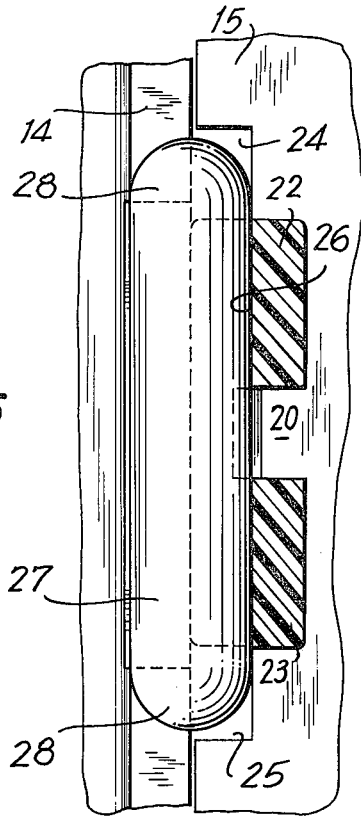
FIG. 6
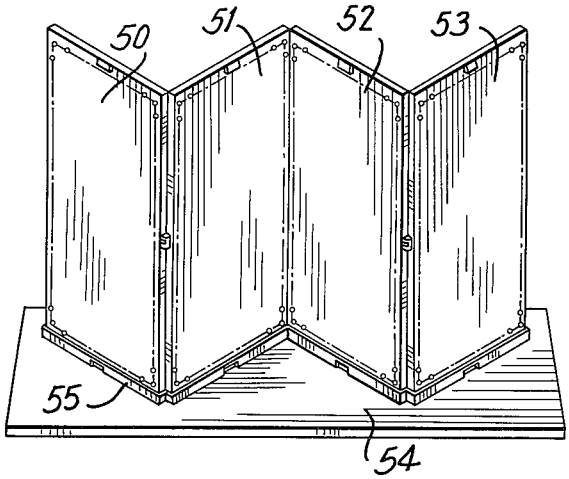
FIG. 7
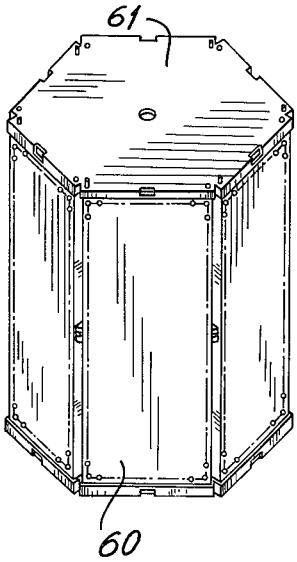
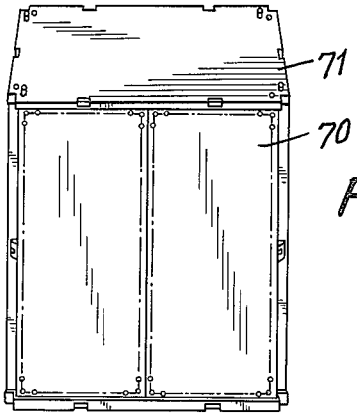
FIG. 8

FIG. 9
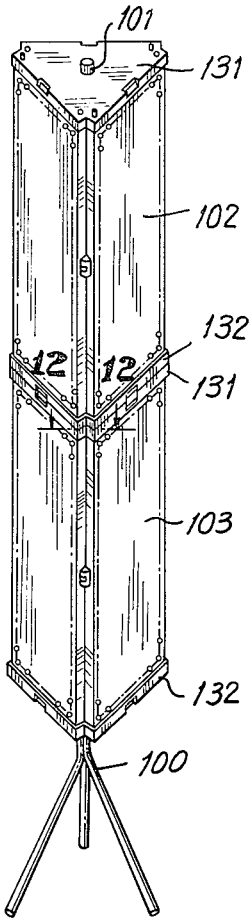
FIG. 10
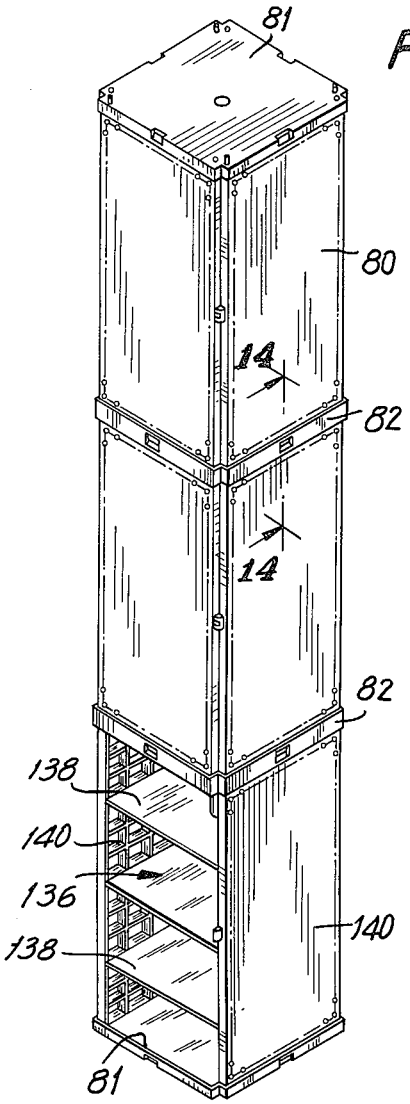
FIG. 11
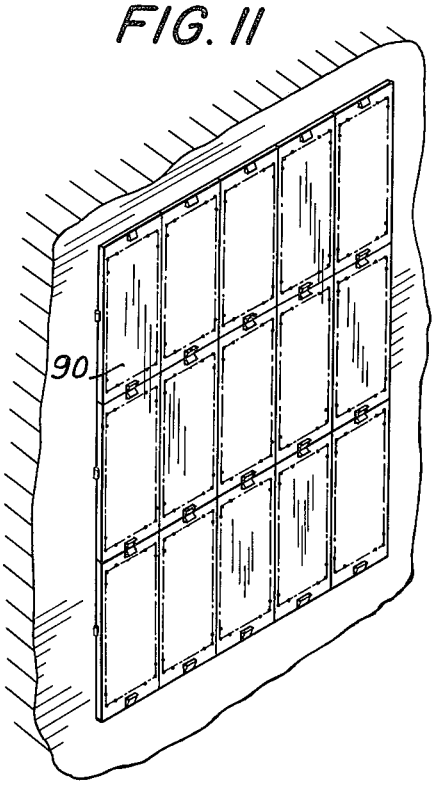
FIG. 12
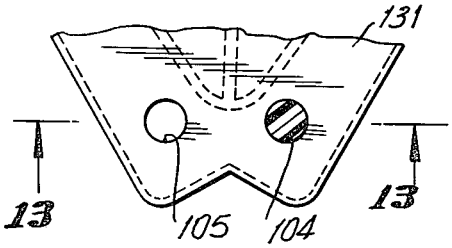
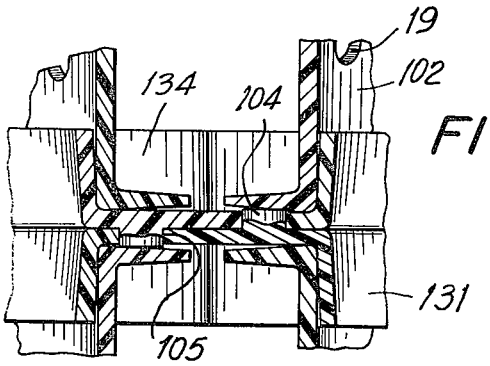
FIG. 13
FIG. 14
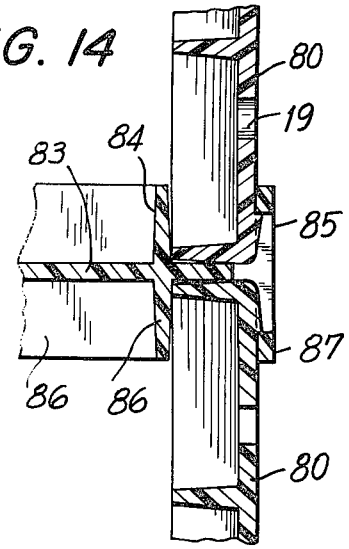

DISPLAY PANEL AND ASSEMBLY

BACKGROUND AND SUMMARY OF THE INVENTION

Merchandising practices currently followed make extensive use of so-called point of purchase displays and the like, in which merchandise is prominently and conveniently displaced before the potential customer. Ideally, the attractive display and immediate availability of the merchandise facilitate and increase the sales thereof.

For the construction of point of purchase displays, perforated panel board (sometimes called peg board) is used to a great extent. Conventionally, such panel board material is thin, flat, relatively rigid, and provided with a large number of apertures arranged in horizontal and vertical rows. A wide variety of panel board hooks and other display fixtures are available, which may be readily inserted into the opening of the apertured panel board, in any configuration convenient to the merchandiser.

The general configuration and general advantages of apertured panel board are well known. The present invention, however, seeks to improve significantly on the conventional apertured panel board construction, by providing a novel and improved form of such panel board, which is of greatly improved utility with respect to set-up and knock-down capability, in particular. The new perforated panel construction is ideally suited to the quick and simple construction of short term point of purchase displays, such as aisle displays in supermarkets and the like.

In accordance with one of the specific aspects of the invention, a molded plastic perforated panel board structure is provided, which includes an advantageous form of snap-together side hinge connection, by means of which adjacent rectangular panel elements may be joined, in a coplanar relationship, an abutting relationship or at an angle. The new hinge construction enables a series of panels to be joined to form a single large, flat panel display, or displays of a variety of geometric configurations, as the circumstances require. The connecting hinge arrangement of the new panel provides for any angular orientation of a pair of adjacent panels between coplanar (0°) and back-to-back (180°). This advantageous structure is provided without the need for separate fastenings or connectors, such that assembly of the panels is greatly simplified, and the inventory of required parts is kept at a minimum.

In conjunction with the above, the invention is directed in part to the provision of an advantageous form of snap-together end plate structure designed for assembly with the new panel board unit, to provide rigid, sturdy point of purchase display assemblies. The end plate elements of the invention are of molded plastic construction, and can be molded in a variety of geometric configurations (such as triangular, rectangular, etc.) of a size and shape to be received on and secured to the end edges of a plurality of connected perforated panels. A unique and advantageous snap-together connection is provided between the end edge portions of the perforated panels and the end plates, enabling the plates to be quickly and securely applied to a series of assembled display panels.

The various modular structural elements of the invention readily accommodate the assembly of display structures of a wide variety of shapes and forms, including flat display boards, back-to-back displays, polygonal displays of various forms, vertically stacked displays and the like. All of this may be accomplished with a relative minimum inventory of parts, and with component parts which are at the same time relatively inexpensive, durable, easily handled, and of pleasing appearance. The structure of the invention provides a display assembly which, in the disassembled condition can be packed away in a minimum of space, easily shipped and handled, and eventually set-up without the use of tools or extraneous fastening devices such as nuts and bolts, or the like.

Moreover, because all of the parts may be of a plastic construction, they are impervious to cleaning solutions or water, and will not oxidize or otherwise degredate in the environment in which they are used. This is particularly important because display structures must be cleaned fairly often so as not to make an unsightly background for the items being displayed, and in many cases they will be used outside. In this connection, further, parts of the structures herein may be of the desired display color, and the color surfaces will not deteriorate as the result of exposure to the environment, or be scratched or otherwise marred as would be the case with painted surfaces. Of course, the invention may take a variety of specific forms and dimensions and may be made of a wide variety of materials, as will be understood by those skilled in the art.

SUMMARY OF PRIOR ART

The structure of the present invention represents a significant improvement over the Ishikawa U.S. Pat. No. 3,452,959 and the Hochman U.S. Pat. No. 3,739,919, which also show forms of perforated display board panels. The Ishikawa patent, for example, illustrates flat rectangular panels of molded plastic construction, arranged with perforations to receive conventional display board hooks and the like. These panels are arranged to be connected together in a flat display assembly, by means of special fastening devices, which are separately supplied. The Hochman patent illustrates a cylindrical display device, formed of a pair of molded, semi-cylindrical elements connected together by an integral "living hinge." The devices of the prior art patents, while having certain advantageous features, are of rather limited overall utility. In contrast, the subject matter of the present invention enables the display assemblies to be constructed in a wide variety of useful and convenient configurations, with an absolute minimum of component parts. Of particular significance, the structure of the present invention avoids the use of small connector elements as required by the Ishikawa patent, for example. In a typical commercial merchandising operation, utilizing relatively low skilled personnel and requiring the relatively frequent and repeated assembly and disassembly and temporary storage of display structures, small parts, such as connector elements, easily become lost and mislaid over a period of time, minimizing the availability of the display equipment and, in some cases, rendering the overall equipment valueless for lack of relatively insignificant component parts.

For a fuller understanding of the above-mentioned and other features and advantages of the invention, reference should be made to the following detailed description of a preferred embodiment of the invention, and to the accompanying drawings and appended claims.

DESCRIPTION OF THE DRAWINGS

FIGS. 4 and 5 are greatly enlarged fragmentary, cross-sectional views taken on lines 4–4, 5—5 respectively of FIGS. 2 and 4.

FIGS. 6–8 are perspective views showing the perforated display panel unit of the invention, as assembled in a variety of contemplated display configurations.

FIG. 9 is a perspective view of a structure according to the invention, providing a vertically stacked display assembly of triangular configuration.

FIG. 10 is a perspective view illustrating another form of vertically stacked display configuration, in this case of rectangular configuration.

FIG. 11 is a perspective view of a flat display panel assembly utilizing a large plurality of display panel units of the invention connected together in edge-to-edge relation.

FIGS. 12–14 are enlarged, fragmentary, cross-sectional views taken on lines 12—12, 13—13, 14—14, respectively, of FIGS. 9, 12 and 10.

DESCRIPTION OF PREFERRED EMBODIMENTS OF THE INVENTION

Figure 1:
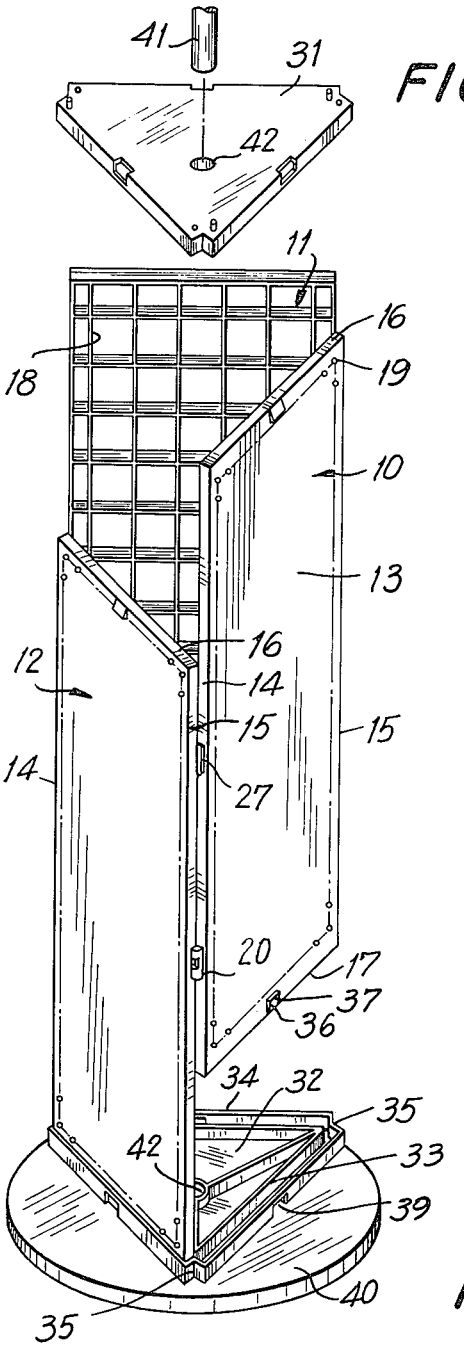
FIG. 1 is a perspective, partially exploded view of a typical display assembly incorporating the features of the invention.

Referring now to the drawings, and initially to FIGS. 1–5 thereof, the reference numerals 10, 11, 12 designate generally three display panels, incorporating structural features of the invention, which are arranged to be assembled in edge-to-edge relationship, in a triangular display configuration. As will be readily apparent, the triangular display configuration is merely illustrative of many such configurations and will be described in an illustrative context only. The display panels 10–12 are of identical construction, desirably being produced by injection molding with a suitable plastic material, such as medium impact polystyrene. Each of the display panels includes a flat, planar panel portion 13, typically of rectangular configuration. Integral side edge flanges 14, 15 and end edge flanges 16, 17 project rearwardly from the edge extremities at the panel portion 13, to impart strength and rigidity and a 3-dimensional characteristic to the display panel. In addition, as is evident in FIG. 1, the back sides of the display panels are provided with a grid of horizontally and vertically disposed, integrally molded ribs 18, which rigidify the entire panel unit. Moreover, ribs 18 serve the added function as spacers if panel 10, for example, should be attached to a flat vertical surface for display. Portions of display hooks extending through apertures 19 in such panels would have sufficient room to extend into the space provided by ribs 18 between the flat wall surface and the adjacent panel surface.

Substantially, the entire front panel portion 13 of each of the display panels is provided with rows of uniformly spaced apertures 19. As will be understood, the size and spacing of the openings is such as to accommodate the reception of conventional peg board hardware, such as display hooks, racks, etc. To this end, the openings 19 are spaced at least slightly away from the structural ribs 18, to permit the openings to receive pairs of upturned locking lugs of a standard merchandise hook.

Perferably, the display panels 10–12 are of rectangular configuration, although a square configuration would be suitable as well, and other configurations would have special application. While specific dimensions are not significant to the invention, an advantageous commerical form of the display panels may have principal length and width dimensions of 24 inches by 12 inches, and an overall thickness of the side flanges and structural ribs of about ½ inch. The ribs 18 may be typically spaced about 2 inches apart, and the apertures 19 of about ¼ inch in diameter being spaced about 1 inch apart, horizontally and vertically. A panel thus constructed, having wall thickness on the order of 3/32 of an inch, and formed of, for example, injection molded medium impact polystyrene, is extremely rigid and rugged and is ideally suited for the intended service.

In accordance with one of the significant aspects of the invention, at least one side edge flange of each display panel (flange 15 in this illustration) is provided with at least one integrally molded female hinge element 20, of generally semi-cylindrical configuration. In the specifically illustrated structure, only one such hinge element 20 is provided on the flange 15. It is located midway along the length of the flange 15 and, in a typical embodiment, may extend for about 1 inch in length and have an internal diameter of about ½ inch. The axis of the semi-cylindrical hinge element 20 is substantially coincident with the outside, rear extremity 21 of the edge flange 15, for reasons which will be more fully described, and the opposite side arms 22, 23 of the hinge element together embrace an arc greater than 180°. The flange 15 itself is recessed for a short distance beyond each end of the hinge element 20, as at 24, 25, to a depth at least as great as the depth of the hinge wall 26, to accommodate the presence of a male hinge element 27, to be described.

On the opposite side edge flange 14 of each display panel is at least one of the male hinge elements 27, which are of generally cylindrical configuration and are molded integrally with the flange 14. In accordance with the invention, the male hinge elements 27 correspond in number, location, and dimensions to the female hinge elements 20. Accordingly, in the illustrated structure, each panel flange 14 has a single male hinge element 27.

As reflected in FIGS. 4 and 5, the hinge element 27 is integrally joined to the panel flange 14 only at the end extremities 28 of the hinge element. Between these end extremities, the flange 14 is provided with an elongated through opening 29, of a length and thickness to receive freely the arm portion 23 of a female hinge element 20. In accordance with the invention, the axis of the male hinge element 27 is substantially coincident with the outer rear edge extremity 30 of the flange 14.

The outside diameter of the male hinge element 27 is substantially identical to the inside diameter of the female hinge element 20 such that, when the elements 20, 27 are in assembled relation, as reflected in FIG. 4, a pair of engaged display panels 10, 12 will swing easily on the hinged connection. However, since the hinge arms 22, 23 of the female element embrace more than 180°of arc (e.g., around 200°), the male hinge element 27 must be forced laterally into its assembled relation to the female element, providing a "snap-together" connection. Once assembled, the hinge parts will remain together until snapped apart by forcing the male hinge element 27 laterally outward through the restricted opening formed by the arms 22, 23.

By locating the axes of the respective hinge parts on the outer rear extremities of the side edge flanges 14, 15, it is possible to swing a pair of connected panels 10, 12 through 180° of movement, from one limit position, in which a pair of adjacent panels are positioned side-by-side, in the same plane and with the edge flanges 14, 15 in substantially directly abutting relationship, to another limit position, in which a pair of connected panels are joined in back-to-back relation. This exceptional versatility makes the display panel invention uniquely adapted for display purposes.

Figure 2:
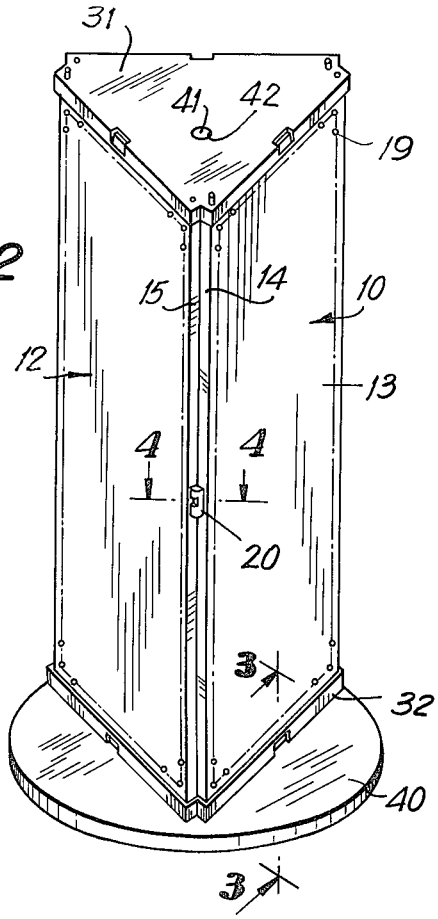
FIG. 2 is a perspective view of the completed display assembly of FIG. 1.

To greatest advantage, the display panels of the invention are associated in a display structure with interlocking end cap members 31, 32. In the structure of FIGS. 1 and 2, the end cap members are of triangular configuration, desirably formed of injection molded plastic material similar to that of the panels themselves. Along their peripheral portions, the end cap members 31, 32 are provided with spaced, parallel inner and outer vertical flanges 33, 34 and associated end flanges 35. Along each side of the end cap members, a spaced pair of inner and outer flanges 33, 34 and a pair of end flanges 35 form a well or socket for the snug reception of an end portion of a display panel 10. The peripheral configuration of an end cap member is appropriate to the number of panels to be assembled in the display, and the end caps are applied to the hingedly connected display panel elements to form a rigid, closed display structure.

In accordance with one advantageous feature of the invention, the display panels 10–12 are provided along their upper and lower edges with integrally molded locking wedges 36 forming inwardly facing abutment surfaces 37 spaced inward from the end flanges 16, 17. To advantage, the locking wedges are located in the mid-region of the panel end edges and are arranged for inter-locking engagement with oppositely facing abutment surfaces 38 formed on the inside of the end cap outer flanges 34 by the provision therein of openings 39. Thus, when a display panel is inserted endwise to the well or socket formed in the end cap member, the locking wedge 36 temporarily forces outwardly the adjacent portion of the outer flange 34, permitting the cooperating abutment surfaces to clear each other. The wedge 36 eventually is received in the opening 39 permitting the abutment surfaces to overlap and thus locking the display panel against removal. To effect disassembly, a suitable pry tool (e.g., a coin) is urged between the front surface of the display panel and the back surface of the flange 34, to free the locking wedge and permit withdrawal of the panel. The arrangement provides for an extremely simple but yet highly secure structural assembly.

Figure 3:
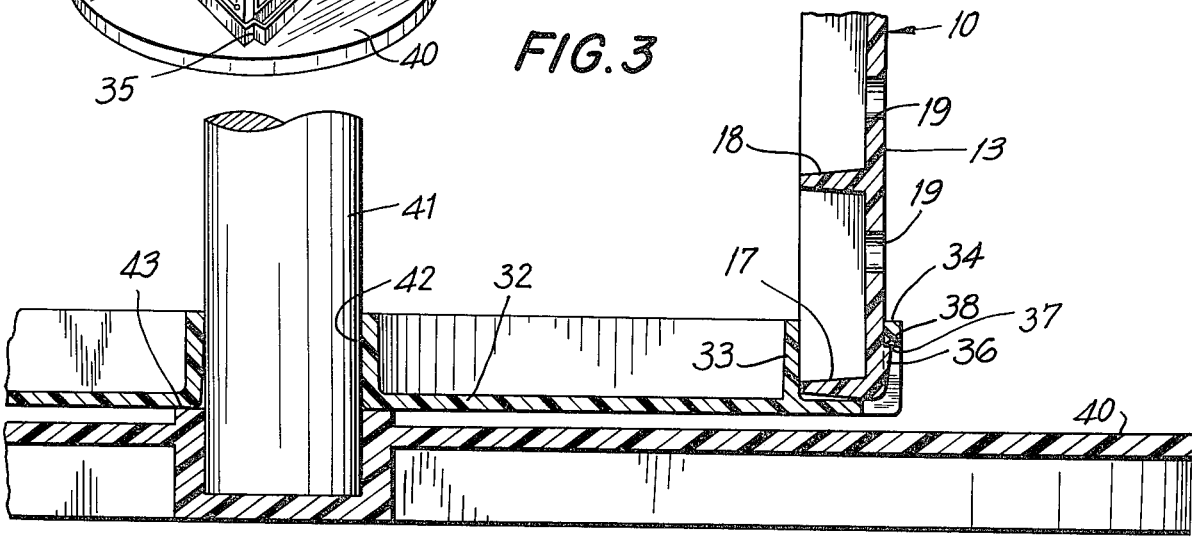
FIG. 3 is a highly enlarged, fragmentary, cross-sectional view taken generally on line 3—3 of FIG. 2.

In the specific display structure of FIGS. 1–3, the triangular configuration of display panels and end caps is mounted rotatably on a display base 40 which supports a vertical pole or spindle 41. The triangular end cap members 31, 32 are provided with central openings 42 arranged for the free sliding reception of the spindle 41. The lower end cap member 32 is supported on a bearing surface 43 formed by the base member 40 such that the fully assembled display structure can be rotated easily on its display base 40.

In the modified form of the invention shown in FIG. 6, a series of four display panels of the type previously described are connected together in folding screen fashion by their respective hinge elements. A molded base member 54, having panel retaining flanges 55 in an appropriate configuration receives the lower end edges of the several panel sections, locking them in upright, self-supporting configuration.

FIGS. 7, 8 and 10 show other representative geometrical configurations of display panels, suggesting the endless variety of arrangements available to the display designer, following the teachings of the invention. In the arrangement of FIG. 7, a series of six panels 60 are assembled with a pair of end cap members 61 of hexagonal configuration In FIG. 8, a series of panels 70 is connected in a rectangular configuration by end cap members 71, providing for a pair of coplanar panels along the major sides, with single panels along the minor sides. In FIG. 10, panels 80 are arranged in a square configuration utilizing appropriately shaped end caps 81. In FIG. 11, a series of panels 90 are connected together side edge to side edge and arranged in coplanar configuration to provide, in effect, an entire wall structure of the perforated panel elements.

In the arrangement shown in FIG. 9, a plurality of display assemblies, in this case of triangular configuration, are arranged in vertically stacked relation. For illustrative purposes, the display assembly includes a suitable stand 100 including a central pole or spindle 101, over which are received upper and lower display assemblies 102, 103, which may be of the general type shown in FIGS. 1 and 2.

To provide for properly locating and aligning the separate display assemblies 102, 103, the respective end cap members 131, 132, which correspond to the end cap members 31, 32 of FIGS. 1 and 2, are provided adjacent each corner with a locating lug 104 and an associated locating aperture 105. When a pair of end cap members are joined in face-to-face relation, in the same geometric orientation, the locating lugs 104 of one end cap will be received in and locked with the locating openings 105 in the other end cap, substantially as reflected in FIG. 13, for example.

In the arrangement in FIG. 10, vertical stacking of a series of display structures may be provided to advantage by utilizing double faced end cap units 82, as reflected more particularly in FIG. 14. Thus, the intermediate end cap units 82 include a central web 83 and symmetrically opposed sets of upwardly and downwardly projecting retaining flanges 84–87. Vertically adjacent display panels 80 are thus received in a single end cap unit, which provides for highly secure and rigid vertical stacking of the units, as will be appreciated.

It should be noted further that it is within the purview of this invention that in the different closed configurations of displays formed, one or more display panels may be omitted, as shown at 136 in FIG. 10. Thus one large object might be displayed in this large space by resting on the floor formed by end cap 81. Alternatively, a plurality of spaced-apart shelves 138 can be positioned in opening 136 for displaying objects not suited for hanging on display hooks positioned on the panels themselves. In this connection, shelves will be supported by suitable brackets received in apertures 19 formed in panels 140 forming the side walls of space 136. It should be noted further that the rear panel forming space 136 (not shown) may also be removed to provide a two-sided access to space 136. As will be understood, shelves 138 may be vertically spaced as desired by moving their supporting brackets vertically in apertures 19.

Figure 15:
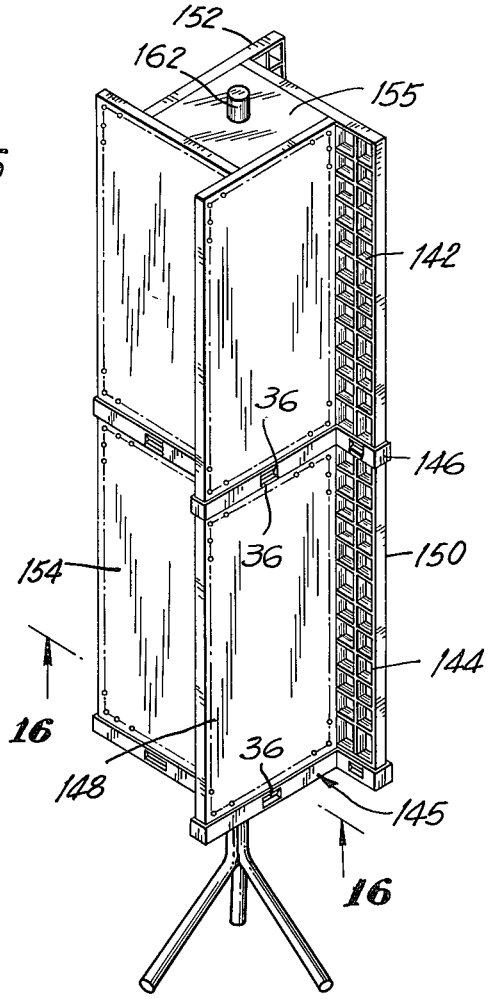
FIG. 15 is a perspective view illustrating another form of vertically stacked display configuration, in this case of four panels in an abutting perpendicular arrangement to each other.
Figure 16:
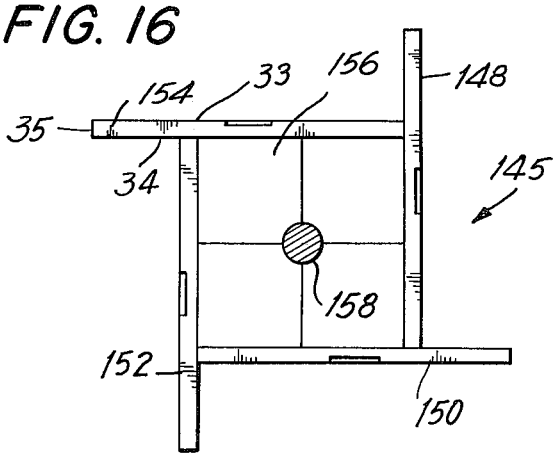
FIG. 16 is a top plan view of the bottom end cap member 145 of FIG. 15 and taking along lines 16—16 of FIG. 15.

In the arrangement of FIGS. 15 and 16, a further embodiment of display structure utilizing vertical stacking is shown. In this structure, a plurality of display panels are disposed in abutting perpendicular arrangement to each other to form a display arrangement having the configuration shown in FIG. 16. That is, a series of upper display panels 142 and lower display panels 144 are connected together by a double faced end cap 146 in the manner of double faced end caps 82 described in FIG. 10. Double faced end cap 146 has the configuration of the arrangement of display panels however, as shown in FIG. 16.

In FIG. 16, bottom end cap 145 is shown having a plurality of sockets 148, 150, 152 and 154 arranged in abutting perpendicular arrangement to each other. Each of the sockets is formed, as described previously, of opposed flanges 33, 34 and end flange 35. End cap 145 has a square web 156 interconnecting sockets 148, 150, 152 and 154, as shown, with web 156 having an opening 158 for receiving a spindle 162 supported on stand 160. Web 156, as well as similar webs for top end cap 155 and double-faced end cap 146 are rotatable on spindle 162. In this embodiment, however, the integral male and female hinge elements 20, 27 are not used.

It must be emphasized that the several varieties of display structures illustrated herein are not in any sense limiting, but are merely illustrative of the great versatility and wide application of the basic structure of the invention. In its most elemental form, the invention is directed to a unique display panel per se, including a novel form of connecting hinge arrangement along the side edge providing for interconnection of adjacent panels without additional fastening means and providing additionally for a full 180° variety of geometrical orientation of adjacent panels. When constructed by injection molding of medium impact polystyrene, for example, the display panel element in a 24 × 12 × ½ inch standard size, with one or two hinge elements along the side edges, provides the display designer with a modular unit of exceptional versatility and of almost unlimited practical application. At the same time, the standard panel units are relatively inexpensive, extremely rugged and durable, easily stored and handled.

Inasmuch as the various described forms of the invention are intended for illustration only, reference should be made to the following appended claims in determining the full scope of the invention.

I claim:

1. A display assembly comprising a. a plurality of closed display assemblies arranged in vertically stacked relation, b. a plurality of display panels disposed in a predetermined closed geometric configuration; each of said display panels comprising 1. a flat panel provided with apertures for the reception of display fixtures, 2. at least one male hinge element of generally cylindrical configuration being provided along at least one side edge of said panel, 3. said male hinge element being integrally molded with said panel and connected thereto at one or more spaced areas, 4. said panel being recessed from said hinge element between said areas, and 5. at least one female hinge element of generally semicylindrical configuration provided along at least an opposite side edge of said panel and embracing an arc of at least slightly more than 180° and accepted for snap-together attachment to a male hinge element of an adjacent display panel, 6. the axes of said hinge elements being substantially coincident with the outer back edge extremities of said panel to accommodate 180° hinged folding of a pair of connected adjacent display panels between abutted back-to-back and abutted edge-to-edge positions, c. a plurality of end cap members, d. said end cap members being formed to provide socket means having a geometric configuration corresponding to that of said plurality of panels and adapted for the end-wise reception of said connected panels to receive said panels in said geometric configuration, and e. at least certain of said end cap members including means for maintaining alignment of corresponding panels of vertically adjacent display structures.

2. The display assembly of claim 1, further characterized by a. said certain end cap members including axially projecting locating lugs whereby, when assemblies are placed in vertically stacked relationship, the lugs of one end cap member are engaged by the vertically adjacent end cap member.

3. The display assembly of claim 1, further characterized by a. said certain end cap members having socket means facing vertically upward and downward and receiving panels of a pair of vertically stacked display assemblies.

4. A display assembly of a plurality of display panels disposed in a predetermined configuration, each said display panel comprising a. a flat perforated panel of molded plastic provided with apertures for the reception of display figures, b. at least one male hinge element of generally cylindrical configuration being provided along at least one side edge of said panel, c. said male hinge element being integrally molded with said panel connected thereto at one or more spaced areas, d. at least one female hinge element of generally cylindrical configuration provided along at least an opposite side edge of said panel and embracing an arc of at least slightly more than 180° and adapted for snap-together attachment to a male hinge element of an adjacent display panel, e. the axes of said hinge elements being substantially coincident with the outer back edge extremities of said panel to accommodate 180° hinged folding of a pair of connected adjacent display panels between a juxtaposed non-offset abutted back-to-back position and an abutted edge-to-edge position with no spacing therebetween, f. said assembly including 1. at least one end cap member, 2. said end cap member being formed to provide socket means having a geometric configuration corresponding to that of said plurality of panels and adapted for the end-wise reception of said connected panels to receive said panels in said geometric configuration,
3. said panels being disposed in a vertical perpendicular relationship to each other,
4. said panels abutting each other at points spaced from the side edges thereof,
5. said end cap members being applied to the opposite ends of said panels to form said display assembly.

5. The display assembly of claim 4, further characterized by a. a plurality of such display structures being arranged in vertically stacked relation, and
b. at least certain of said end cap members including means for maintaining alignment of corresponding vertically adjacent panels.

6. The display assembly of claim 5, further characterized by a. said certain end cap members having socket means facing vertically upward and downward and receiving panels of a pair of vertically stacked display assemblies.

7. A perforated display panel of molded plastic construction, which comprises a. a flat panel portion provided with a plurality of apertures for the reception of display fixtures,
b. integral peripheral edge flanges extending about the side and end edges of the flat panel and projecting rearwardly therefrom to define the edges of the display panel,
c. at least one male hinge element of generally cylindrical configuration provided along at least one side edge flange of said display panel,
d. said male hinge element being integrally molded with said one side edge and connected thereto at one or more spaced areas,
e. at least one female hinge element of generally semi-cylindrical configuration provided along at least an opposite side edge flange of said display panel and adapted for snap-together attachment to a male hinge element of an adjacent display panel,
f. the axes of said hinge elements being substantially coincident with the outer back edge extremities of said side edge flanges to accommodate 180° hinged folding of a pair of connected adjacent display panels between a juxtaposed non-offset abutted back-to-back position, and an abutted edge-to-edge position with no spacing therebetween,
g. the upper and lower peripheral end flanges including integrally molded locking wedge means,
h. end cap means for cooperative association with said display panel and including spaced panel receiving flanges,
i. one of said panel receiving flanges being recessed in a region opposite the locking wedge means of a panel edge to effect mechanical interlock of a panel and end cap.

* * * * *